US012372307B2

(12) United States Patent
Mayrl et al.

(10) Patent No.: US 12,372,307 B2
(45) Date of Patent: Jul. 29, 2025

(54) DEVICE FOR TRANSFERRING HEAT FROM A GASEOUS WORKING MEDIUM

(71) Applicant: RIMACOMP—GmbH, Vienna (AT)

(72) Inventors: Martin Mayrl, Vienna (AT); Peter Mayrl, Bockfliess (AT)

(73) Assignee: RIMACOMP—GmbH, Vienna (AT)

( * ) Notice: Subject to any disclaimer, the term of this patent is extended or adjusted under 35 U.S.C. 154(b) by 161 days.

(21) Appl. No.: 18/280,005

(22) PCT Filed: Jan. 12, 2022

(86) PCT No.: PCT/AT2022/060006
§ 371 (c)(1),
(2) Date: Sep. 1, 2023

(87) PCT Pub. No.: WO2022/183224
PCT Pub. Date: Sep. 9, 2022

(65) Prior Publication Data

US 2024/0068751 A1 Feb. 29, 2024

(30) Foreign Application Priority Data

Mar. 2, 2021 (AT) ..... A 50146/2021

(51) Int. Cl.
*F28D 7/10* (2006.01)
*F04B 35/00* (2006.01)
(Continued)

(52) U.S. Cl.
CPC ..... *F28D 7/103* (2013.01); *F04B 35/008* (2013.01); *F04B 39/06* (2013.01); *F28D 7/0066* (2013.01); *F04B 31/00* (2013.01)

(58) Field of Classification Search
CPC ..... F28D 7/103; F28D 7/0066; F04B 35/008; F04B 39/06; F04B 31/00
See application file for complete search history.

(56) References Cited

U.S. PATENT DOCUMENTS 1,929,350 A 10/1933 Christensen
2005/0180864 A1* 8/2005 Ursan ..... F04B 31/00 417/56
(Continued)

FOREIGN PATENT DOCUMENTS

AT 506796 A4 12/2009
DE 19846481 A1 5/2000
(Continued)

OTHER PUBLICATIONS

Search Report for Austrian Patent Application No. A 50146/2021 dated Jul. 29, 2021 (1 Page).
(Continued)

*Primary Examiner* — Eric S Ruppert
(74) *Attorney, Agent, or Firm* — Eversheds Sutherland (US) LLP

(57) ABSTRACT

The invention relates to a device (1) for transferring heat from a gaseous working medium (M2) to a heat-exchanger medium (M3) by compressing the gaseous working medium (M2), wherein the device (1) comprises: an operating line (AL), wherein the volume (V) enclosed by the operating line (AL) is divided into at least two sections, namely a first (AL-V1) and a second section (AL-V2), wherein the first section (AL-V1) is set up to hold a pressure-transfer medium (M1) and the second section (AL-V2) is set up to hold and discharge the gaseous working medium (M2), wherein at least one inlet and outlet valve (2) is provided for holding and discharging the gaseous working medium (M2), wherein a first volume delimited by the first section (AL-V1) is separated from a second volume delimited by the second section (AL-V2) by a first separating layer (T12) that can be displaced within the operating line (AL), wherein the first separating layer (T12) is arranged in such a way that pressure differences between the first (AL-V1) and second sections (AL-V2) of the operating line (AL) are equalized by
(Continued)

Figure 1:
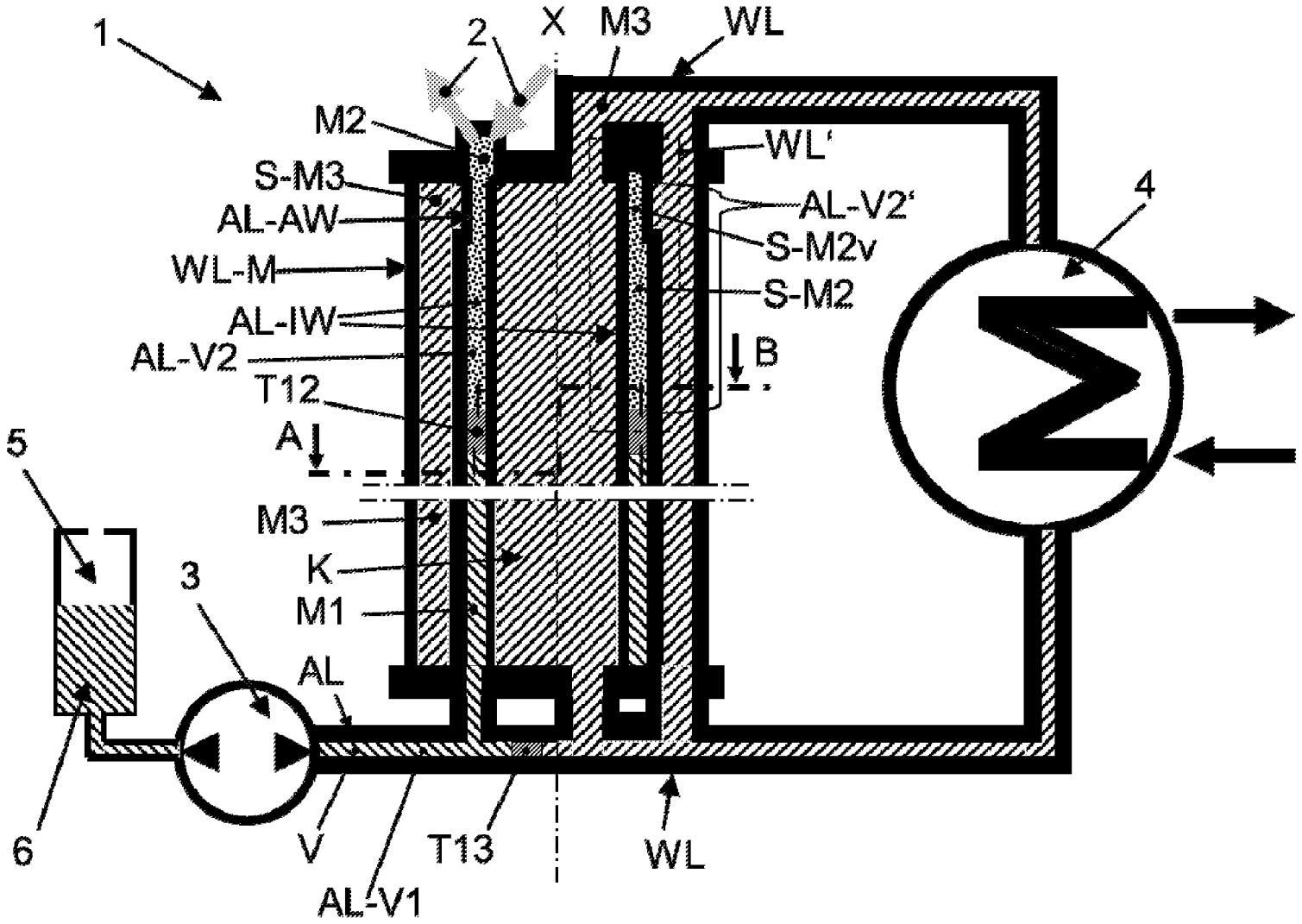

a displacement of the first separating layer (T12) in the operating line (AL) and an accompanying change in the proportion between the first volume and the second volume is equalized, and comprising a heat-exchanger line (WL) to hold the heat-exchanger medium (M3), wherein the heat-exchanger line (WL) is coupled to the first section (AL-V1) of the operating line (AL) to bring about pressure equalization.

19 Claims, 2 Drawing Sheets

(51) Int. Cl.

| | |
|---|---|
| ***F04B 39/06*** | (2006.01) |
| ***F28D 7/00*** | (2006.01) |
| *F04B 31/00* | (2006.01) |

(56) References Cited

U.S. PATENT DOCUMENTS

| | | | | |
|---|---|---|---|---|
| 2009/0126371 | A1 | 5/2009 | Powell et al. | |
| 2018/0371959 | A1 | 12/2018 | Ebert et al. | |
| 2022/0065401 | A1* | 3/2022 | Edoardo | F04B 39/0011 |

FOREIGN PATENT DOCUMENTS

| | | | |
|---|---|---|---|
| DE | 102011015371 | A1 | 10/2012 |
| WO | 2010128224 | A1 | 11/2010 |

OTHER PUBLICATIONS

Search Report and Written Opinion for International Patent Application No. PCT/AT2022/060006 dated Mar. 31, 2022 (14 Pages).

* cited by examiner

DEVICE FOR TRANSFERRING HEAT FROM A GASEOUS WORKING MEDIUM

The invention relates to a device for transferring heat from a gaseous working medium to a heat-exchanger medium by compressing the gaseous working medium, wherein the device comprises the following: a heat-exchanger line to accommodate the heat-exchanger medium and an operating line, wherein the volume enclosed by the operating line is divided into at least two sections, namely a first and a second section, wherein the first section is set up to hold a pressure-transfer medium and the second section is set up to hold and discharge the gaseous working medium, wherein at least one inlet and outlet valve is provided for receiving and discharging the gaseous working medium, wherein a first volume delimited by the first section is separated from a second volume delimited by the second section by a first separating layer which can be displaced in the operating line, wherein the first separating layer is arranged in such a way that pressure differences between the first and second sections of the operating line are caused by a displacement of the first separating layer in the operating line and an accompanying change in the proportion between the first volume can be equalized to the second volume.

For example, heat pumps have become known from prior art that are set up to supply preheated fresh air into an interior where applicable, for example, of a building or a vehicle cabin of a vehicle. In this process, heat is transferred to a heat-exchanger medium with the aid of compression of a working medium, wherein the efficiency of such a heat pump is strongly dependent on the flow temperature of the working medium as well as on the pressures used. With conventional heat pumps, such as those used in building services, pressures of a few bars can prevail for example. In principle, the use of a higher operating pressure allows a higher degree of efficiency. However, higher pressures also lead to higher requirements with regard to the materials used and the construction to be used. In order to achieve good efficiency at low pressures, it has therefore been customary to preheat the working medium, particularly in the form of outside air, which can be done by using geothermal energy for example. However, this is associated with considerable costs. In addition, such measures also require a correspondingly large amount of space.

An object of the invention is therefore to create a device for the transfer of heat that overcomes the disadvantages initially mentioned, thereby enabling a compact design with high efficiency.

This task is solved by means of a device of the aforementioned type, in which, according to the invention, the heat-exchanger line is coupled to the first section of the operating line to bring about pressure equalization by connecting the heat-exchanger line to the first section of the operating line and by providing a second separating layer between these lines for separating the lines from each other, wherein the second separating layer is designed and arranged in such a way that there is a continuous pressure equalization between the heat-exchanger line and the first section of the operating line, wherein the second section of the operating line comprises a heat-emission section which is enclosed by a two-part heat-absorption section of the heat-exchanger line on the outer side and on the inner side while the operating line comprises an inner wall and an outer wall encapsulating the inner wall, and a working-medium gap is formed between the inner wall and the outer wall for guiding the working medium, wherein the inner wall encloses a channel through which a first part of the heat-exchanger line is formed in the heat-absorption section, and the heat-exchanger line in the heat-absorption section also comprises a shell wall encasing the outer wall of the operating line, through which a second part of the heat-exchanger line in the heat-absorption section is formed and delimited, wherein, between the outer wall of the operating line and the shell wall of the heat-exchanger line, a heat-exchanger-medium gap connected parallel to the channel is formed so that a heat-exchanger medium conveyed in the heat-absorption section of the heat-exchanger line can flow around the operating line on the outside via the heat-exchanger-medium gap and on the inside via the channel.

Due to the embodiment of the device according to the invention, it is possible to enable a very wide working range with regard to the pressures prevailing in the device. Since the heat-exchanger medium can flow around the operating line in the heat-emission section on both sides, a particularly efficient heat transfer to the heat-exchanger medium can take place.

Another particular advantage is that, due to the pressure coupling between the pressure transfer, the heat-exchanger medium and the working medium, a pressure equilibrium can be established that makes it possible to design the walls of the operating line in the area of the heat-emission section significantly thinner than they would have to be if there were no corresponding pressure equalization. In fact, the walls only need to be designed in such a way that they allow for a corresponding control of the first separating layer and ensure mechanical stability of the lines, since there is largely the same pressure on the inside and outside of the walls of the operating line. This means, for example, that the walls can be made more than 50% thinner than would be possible without corresponding pressure equalization. As a result, the efficiency of heat transfer between the working medium and the heat-exchanger medium can be additionally increased. Expressed in absolute figures, the wall thicknesses in the heat-emission or hat absorption section, with the exception of the wall thickness of the outer shell wall of the heat-exchanger line, could, for example, have a thickness between 1 mm and 4 mm, in particular, less than 10 mm.

Due to the device according to the invention, which can, for example, be used in the form of a heat pump for a building or a vehicle, in particular, an electric vehicle, COP values in the range of 5 to 8 can be achieved.

The at least one intake and outlet valve does not have to be a single piece. Of course, a separate inlet valve and a separate outlet valve can be provided. A plurality of valves can also be provided. The expression "pressure of a line" naturally refers to the pressure that prevails in the medium absorbed in the line, i.e., an equalization of pressure between two lines means that there is a pressure equalization between the media held in the lines.

Pressure equalization is preferably carried out in such a way that there are essentially no tensile or compressive stresses in the radial direction of the lines. This allows the walls that are present between the working medium and the heat-exchanger medium in the heat-emission section to be extremely thin-walled, which enables better heat transfer.

The device according to the invention can function, for example, in such a way that cyclic pressure changes are transmitted to the two separating layers via the pressure-transfer medium, wherein an increase in pressure leads at least to a displacement of the first separating layer so that the working medium held in the first section is compressed and thus heated. The heated working medium transfers the heat to the heat-exchanger medium. The pressure is increased until the first separating layer has reached a final position, and, after sufficient heat transfer, the outlet valve is opened to release the working medium. The pressure of the pressure-transfer medium is then lowered so that the first separating layer moves back, and fresh working medium is sucked into the second section via an inlet valve that can now be opened.

In particular, it can be provided that the heat-exchanger medium is at least partially gaseous. This can be, for example, heated water vapour, and mixed forms of gaseous and liquid states are also conceivable.

Furthermore, it can be provided that the heat-exchanger medium is a liquid medium, in particular, water. The state specifications always refer to the thermal states during the nominal operation of the device according to the invention and refer to the nominal value of the pressure and temperature range prevailing in the medium.

In particular, it can be provided that the pressure-transfer medium in the first section of the operating line is an oil.

The device according to the invention can of course contain the corresponding media or also be filled accordingly when it is delivered.

Furthermore, it can be provided that the first separating layer is formed directly by the boundary surface formed on the basis of the surface tension of the liquid pressure-transfer medium in relation to the gaseous working medium.

The separating layers mentioned above, i.e., the first and second separating layers, can each be given simply by the boundary layer, which forms two non-mixable media to each other. For example, separating layers can be formed by the transition between oil and air or oil and water. The lines in the transition areas can be orientated in such a way that, due to the different densities of the media used, an boundary surface is formed that runs transversely, in particular, running normally to the respective line cross-section, thereby separating the media from each other across short distances. For example, the lines in the transition area of the media could be perpendicularly orientated and, in this way, for example, a boundary between an oil (as a pressure-transfer medium) and air (as a working medium) could be created by collecting the oil into the lower part of the vertical line section due to its higher density.

Alternatively, it can be provided that the first separating layer is formed by a first separating means provided for this purpose, which is preferably designed as a first seal element that is spatially displaceable. Such a seal element can be implemented, for example, as an O-ring or as a lip seal.

Furthermore, it can be provided that the heat-exchanger line is symmetrically formed around a longitudinal axis in the area of the heat-absorption section.

In particular, it can be provided that the operating line in the heat-emission section is formed as a concentric double pipe formed coaxially to the longitudinal axis of the heat-exchanger line in the area of the heat-absorption section, wherein the working-medium gap between the inner wall and the outer wall of the double pipe is formed and delimited by them, wherein the shell wall of the heat-exchanger line encloses the double pipe and the channel is separated from the inner wall of the double pipe is enclosed.

Furthermore, it can be provided that the inner wall and the outer wall form a multi-toothed star in a cross-section, which is, in particular, axially or point-symmetrical, wherein the star formed by the outer wall is preferably an enlargement of the star formed by the inner wall. Due to the formation as a star, the surface area of the respective wall is significantly increased, which improves the heat exchange between the working medium and the heat-exchanger medium. Normally, the use of such structures in systems that are under high pressure is extremely difficult due to bending stresses occurring in the respective tips. In the present case, however, the pressure equalization between the media allows the use of complex geometries with low wall thicknesses despite high ambient pressures. The enlargement preferably takes place in such a way that the outer star has the same geometric shape as the inner star and is only a proportional enlargement of the inner star. If the outer star is proportionally reduced, it could therefore be brought into congruent agreement with the inner star.

In particular, it can be provided that the operating line in one area of the heat-emission section is designed in such a way that the working-medium gap tapers towards at least one inlet and outlet valve. The gap width of at least 20%, preferably 30%, particularly 50%, or 80% can be tapered compared to the non-tapered area of the operating line. In this way, the heat transfer can be further improved.

Furthermore, it can be provided that the operating line is distributed to branches connected in parallel, at least within the heat-emission section.

In particular, it can be provided that the device is designed for a nominal operating pressure between 6 bar and 1,000 bar, preferably between 50 bar and 100 bar by designing the operating line and the heat-exchanger line as well as at least one inlet and outlet valve to withstand the nominal operating pressure. Pressures of 1,000 bar can be useful for hydrogen applications. If the device according to the invention is to be used as a heat pump, operating pressures of, for example, at least 10 bar (i.e., pressures in the transmission medium or first section, which are then transferred to the remaining media), wherein 50 bar to 100 bar would appear to be particularly useful for this invention. The higher the pressure is selected, the better the efficiency of the device.

The device according to the invention can be dimensioned in a wide variety of sizes. For example, a weight of the order of 10 kg with dimensions of less than 30 cm can be provided for small systems, which means that the device can be used particularly well for vehicles for example. However, it is also conceivable that it could be used for large-scale systems, so that the weight of the device could be a plurality of tons and the overall height could be about 3 m. The device according to the invention is excellently scalable in terms of its performance.

Furthermore, it can be provided that the device also comprises a pump for the transfer of pressure to a pressure-transfer medium contained in the first section of the operating line, wherein the pump is preferably designed as a rotary piston pump, a piston pump, a gear pump or a vane pump.

In particular, it can be provided that the device also comprises a heat exchanger, wherein the heat-exchanger line is connected to the heat exchanger for the emission of heat.

Furthermore, it can be provided that the second separating layer is formed by a second separating means provided for this purpose, which is preferably designed as a spatially displaceable second seal element, which is designed as an elastic membrane permanently mounted at its edges or designed to be spatially displaceable in its entirety. The second seal element can be designed, for example, as an O-ring or as a lip seal.

The present invention enables a design for the approximately isothermal compression of gases by means of piston compressors. In this case, the energy used for heat exchange can be reduced when compressing gases, thereby increasing efficiency. When compressing gases, two resistances are basically overcome:

1. Resistance by reducing the volume

2. By reducing the volume, the temperature is continuously increased and thus the resistance for further compression is increased.

If it is possible to dissipate the heat energy continuously during compression (i.e., a temperature that is as constant as possible), this means a considerable reduction in energy consumption. In this design or device according to the invention, an almost continuous emission of the heat energy during the compression process can be achieved on a piston basis.

By the way, it should be mentioned that the compressed and cooled working medium can reach extremely low temperatures during decompression via the outlet valve. The discharged working medium is ideally suited for cooling purposes of all kinds, both for room air conditioning as well as for cold stores and applications in the chemical industry.

The invention is explained in more detail below by means of an exemplary and non-limiting embodiment, which is illustrated in the figures. The figure show:

FIG. 1 a schematic illustration of a device according to the invention, and

Figure 2:
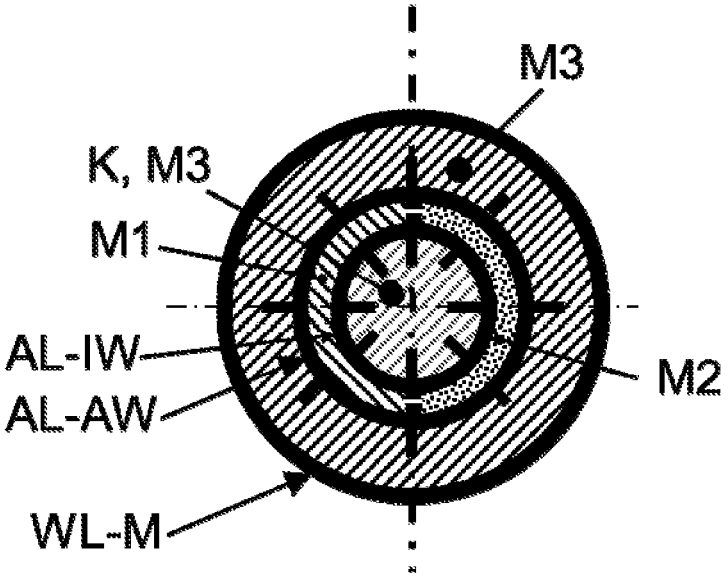

FIG. 2 a cross-sectional illustration corresponding to the section line A-B of FIG. 1.

In the following figures, unless otherwise stated, the same reference numbers denote the same features. FIG. 1 shows an embodiment of a device according to the invention 1 for transferring heat from a gaseous working medium M2 to a heat-exchanger medium M3 by compressing the gaseous working medium M2. Herein, device 1 comprises a operating line AL, wherein the volume V enclosed by the operating line AL is divided into at least two sections, namely a first AL-V1 and a second section AL-V2. The first section AL-V1 is set up to hold a pressure-transfer medium M1 and the second section AL-V2 to hold and release the gaseous working medium M2. At least one inlet and outlet valve 2 is provided for the absorption and discharge of the gaseous working medium M2, wherein a first volume delimited by the first section AL-V1 is separated from a second volume delimited by the second section AL-V2 by a first separating layer T12 which can be displaced in the operating line AL.

The first separating layer T12 is arranged in such a way that pressure differences between the first AL-V1 and the second section AL-V2 of the operating line AL are equalized by a displacement of the first separating layer T12 in the operating line AL (the displacement is indicated by arrows in FIG. 1 as an example) and a accompanying change in the proportion between the first volume and the second volume is equalized, wherein the working medium M2 can thus be compressed and thus heated.

Furthermore, device 1 includes a heat-exchanger line WL to hold the heat-exchanger medium M3. In this case, the heat-exchanger line WL is coupled to the first section AL-V1 of the operating line AL in order to bring about pressure equalization while the heat-exchanger line WL is connected to the first section AL-V1 of the operating line AL and a second separating layer T13 is provided between these lines (i.e., the operating line AL and the heat-exchanger line WL) to separate the lines from each other.

The second separating layer T13 is designed and arranged in such a way that there is a continuous pressure equalization between the heat-exchanger line WL and the first section AL-V1 of the operating line AL. The second section AL-V2 of the operating line AL comprises a heat-emission section AL-V2' (for a better overview, this is marked only on one side of the x-axis symmetrical structure and provided with reference numbers), which is enclosed on the outside and inside by a two-part heat-absorption section WL' of the heat-exchanger line WL while the operating line AL comprises an inner wall AL-IW and an outer wall AL-AW encapsulating the inner wall AL-IW (see also FIG. 2), and, between the inner wall AL-IW and the outer wall AL-AW, a working-medium gap S-M2 is formed to guide the working medium M2. The inner wall AL-IW encloses a channel K, through which a first part of the heat-exchanger line WL is formed in the heat-absorption section WL'. In addition, the heat-exchanger line WL in the heat-absorption section WL' also comprises a shell wall WL-M enveloping the outer wall AL-AW of the operating line AL, through which a second part of the heat-exchanger line WL is formed and delimited in the heat-absorption section. A heat-exchanger-medium gap S-M3 connected in parallel with channel K is formed between the outer wall AL-AW of the operating line AL and the shell wall WL-M of the heat-exchanger line WL so that a heat-exchanger medium M3 conveyed in the heat-absorption section WL' of the heat-exchanger line WL can flow around the operating line AL on the outside via the heat-exchanger-medium gap S-M3 and on the inside via the channel K.

In addition, in FIG. 1 shows a pump 3 by means of which the pressure-transfer medium M1 can be pressurized. If the pressure is increased, the separating layer T12 is moved in the direction of the valves 2, and in the case of closed valves, the working medium M2 is compressed and thus heated. After a predetermined time period and/or compression and heat transfer to the heat-exchanger medium M3, the outlet valve 2 is opened, the pressure on the pressure-transfer medium M1 is lowered so that the separating layer 12 can move downwards again and fresh working medium M2 can flow into the second section AL-V2 via the inlet valve 2, which can subsequently be compressed and heated again by increasing the pressure. In the case of the pump 3 shown in FIG. 1, it is, for example, a hydraulic pump in which hydraulic fluid 6 held in a container 5 is shown.

For example, the heat-exchanger medium M3 can be a liquid medium, in particular, water. In addition, it can be provided that the pressure-transfer medium M1 in the first section AL-V1 of the operating line AL is an oil. Depending on the media used, the first separating layer T12 can be formed directly by the boundary surface formed on the basis of the surface tension of the liquid pressure-transfer medium M1 in relation to the gaseous working medium M2.

Alternatively, the first separating layer T12 can be formed by a first separating means T12 provided for this purpose, which is preferably designed as a spatially displaceable first seal element. Similarly, the second separating layer T13 can be formed by a second separating means provided for this purpose, which is preferably designed as a spatially displaceable second seal element, which is designed as an elastic membrane permanently mounted at its edges or designed to be spatially displaceable in its entirety. The first separating layer T12 and/or the second separating layer T13 can also each be formed by the surface of a separating cylinder, which can be kept displaceable in the operating line AL.

In addition, in FIG. 1 in conjunction with FIG. 2 shows that the heat-exchanger line WL is symmetrically formed around a longitudinal axis x in the area of the heat-absorption section WL'. More precisely, the operating line AL in the heat-emission section AL-V2' can be designed as a concentric double pipe, which is formed coaxially to the longitudinal axis x of the heat-exchanger line WL in the area of the heat-absorption section WL', wherein the working-medium gap S-M2 is formed between the inner wall AL-IW and the outer wall AL-AW of the double pipe and is delimited by them, wherein the shell wall WL-M of the heat-exchanger line WL encloses the double pipe and the channel K is separated from the inner wall AL-IW of the double pipe (see also FIG. 2). On the inner wall AL-IW, cooling fins projecting into channel K can be provided to improve heat exchange. In FIG. 2, further cooling fins are also shown, which project from the outer wall AL-AW into the heat-exchanger-medium gap S-M3 to improve heat exchange.

Contrary to what is depicted in the figures, the inner wall AL-IW and the outer wall AL-AW can form a multi-toothed star in cross-section, which is, in particular, axially or point-symmetrical, wherein the star formed by the outer wall AL-AW is preferably an enlargement of the star formed by the inner wall AL-IW.

In addition, it is evident in FIG. 1 that the operating line AL in an area of the heat-emission section AL-V2' is designed in such a way that the working-medium gap S-M2 tapers towards at least one inlet and outlet valve 2. This area is marked with the reference S-M2*v*.

It can also be provided that the operating line AL is distributed to branches connected in parallel, at least within the heat-emission section WL' AL-V2'. The term "connected in parallel" means that the medium guided in parallel can mix again after the parallel connection.

In FIG. 1, a heat exchanger 4 is also shown, which can be part of the device 1, wherein the heat-exchanger line WL is connected to the heat exchanger 4 for the emission of heat.

The invention is not limited to the embodiments shown but is defined by the entire scope of protection of the claims. Also, individual aspects of the invention or the embodiments can be held and combined with each other. Any reference numbers in the claims are exemplary and serve only to make the claims easier to read without limiting them.

The invention claimed is:

1. A device (1) for transferring heat from a gaseous working medium (M2) to a heat-exchanger medium (M3) by compressing the gaseous working medium (M2), wherein the device (1) comprises:

an operating line (AL), wherein the volume (V) enclosed by the operating line (AL) is divided into at least two sections, namely a first (AL-V1) and a second section (AL-V2), wherein the first section (AL-V1) is set up to hold a pressure-transfer medium (M1) and the second section (AL-V2) is set up to hold and discharge the gaseous working medium (M2), wherein at least one inlet and outlet valve (2) is provided to hold and discharge the gaseous working medium (M2), wherein a first volume delimited by the first section (AL-V1) is separated from a second volume delimited by the second section (AL-V2) by a first separating layer (T12) that can be displaced within the operating line (AL), wherein the first separating layer (T12) is arranged in such a way that pressure differences between the first (AL-V1) and second (AL-V2) sections of the operating line (AL) are equalized by a displacement of the first separating layer (T12) in the operating line (AL) and an accompanying change in the proportion between the first volume and the second volume is equalized; and a heat-exchanger line (WL) to hold the heat-exchanger medium (M3), wherein the heat-exchanger line (WL) is coupled to the first section (AL-V1) of the operating line (AL) in order to bring about pressure equalization by connecting the heat-exchanger line (WL) to the first section (AL-V1) of the operating line (AL) and a second separating layer (T13) is provided between these lines (WL, AL) for separating the lines (WL, AL) from each other, wherein the second separating layer (T13) is designed and arranged in such a way that there is a continuous pressure equalization between the heat-exchanger line (WL) and the first section (AL-V1) of the operating line (AL), and wherein the second section (AL-V2) of the operating line (AL) comprises a heat-emission section (AL-VT) enclosed by a two-part heat-absorption section (WL') of the heat-exchanger line (WL) on the outside and inside while the operating line (AL) comprises an inner wall (AL-IW) and an outer wall (AL-AW) encapsulating the inner wall (AL-IW), and, between the inner wall (AL-IW) and the outer wall (AL-AW), a working-medium gap (S-M2) is formed to guide the working medium (M2), wherein the inner wall (AL-IW) is enclosed by a channel (K) through which a first part of the heat-exchanger line (WL) is formed in the heat-absorption section (WL'), and the heat-exchanger line (WL) in the heat-absorption section (WL') also comprises a shell wall (WL-M) enveloping the outer wall (AL-AW) of the operating line (AL), through which a second part of the heat-exchanger line (WL) is formed and delimited in the heat-absorption section (WL'), wherein, between the outer wall (AL-AW) of the operating line (AL) and the shell wall (WL-M) of the heat-exchanger line, (WL), a heat-exchanger-medium gap (S-M3) connected in parallel with the channel (K) is formed so that a heat-exchanger medium (M3) conveyed in the heat-absorption section (WL') of the heat-exchanger line (WL) can flow around the operating line (AL) on the outside via the heat-exchanger-medium gap (S-M3) and on the inside via the channel (K).

2. The device (1) according to claim 1, wherein the heat-exchanger medium (M3) is at least partially gaseous.

3. The device (1) according to claim 1, wherein the heat-exchanger medium (M3) is a liquid medium.

4. The device (1) according to claim 1, wherein the pressure-transfer medium (M1) in the first section (AL-V1) of the operating line (AL) is an oil.

5. The device (1) according to claim 4, wherein the first separating layer (T12) is formed directly by the boundary surface formed on the basis of the surface tension of the liquid pressure-transfer medium (M1) with respect to the gaseous working medium (M2).

6. The device (1) according to claim 1, wherein the first separating layer (T12) is formed by a first separating means provided for this purpose, which is preferably formed as a first seal element that can be spatially displaced.

7. The device (1) according to claim 1, wherein the heat-exchanger line (WL) is formed symmetrically around a longitudinal axis (x) in the region of the heat-absorption section (WL').

8. The device (1) according to claim 7, wherein the operating line (AL) in the heat-emission section (AL-V2') is formed as a concentric double pipe formed coaxially to the longitudinal axis (x) of the heat-exchanger line (WL) in the region of the heat-absorption section (WL'), wherein the working-medium gap (S-M2) is formed between the inner wall (AL-IW) and the outer wall (AL-AW) of the double pipe and delimited by them, wherein the shell wall (WL-M) of the heat-exchanger line (WL) is the double pipe and the channel (K) is enclosed by the inner wall (AL-IW) of the double pipe.

9. The device according to claim 1, wherein the inner wall (AL-IW) and the outer wall (AL-AW) form a multi-toothed star in a cross-section, which multi-toothed star is, in particular, axially or point-symmetrically formed.

10. The device (1) according to claim 1, wherein the operating line (AL) in one area of the heat-emission section (AL-V2') is designed in such a way that the working-medium gap (S-M2) tapers towards at least one inlet and outlet valve (2).

11. The device (1) according to claim 1, wherein the operating line (AL) is distributed at least within the heat-emission section on branches connected in parallel.

12. The device (1) according to claim 1, wherein the device (1) is designed for a nominal operating pressure between 6 bar and 1000 bar by designing the operating line (AL) and the heat-exchanger line (WL) as well as the at least one inlet and outlet valve (2) to withstand the nominal operating pressure.

13. The device (1) according to claim 1, further comprising a pump (3) for transferring pressure to a pressure-transfer medium (M1) contained in the first section (AL-V1) of the operating line (AL).

14. The device (1) according to claim 1, further comprising a heat exchanger (4), wherein the heat-exchanger line (WL) is connected to the heat exchanger (4) for dissipating heat.

15. The device (1) according to claim 1, wherein the second separating layer (T13) is formed by a second separating means provided for this purpose, which is preferably designed as a spatially displaceable second seal element, which is designed as an elastic membrane firmly mounted at its edges or designed to be spatially displaceable in its entirety.

16. The device (1) according to claim 3, wherein the liquid medium is water.

17. The device according to claim 9, wherein the star formed by the outer wall (AL-AW) is an enlargement of the star formed by the inner wall (AL-IW).

18. The device according to claim 12, wherein the device (1) is designed for a nominal operating pressure between 50 bar and 100 bar.

19. The device according to claim 13, wherein the pump (3) is a rotary piston pump, a piston pump, a gear pump or a vane pump.

* * * * *